US006710523B2

(12) United States Patent
Segawa et al.

(10) Patent No.: US 6,710,523 B2
(45) Date of Patent: Mar. 23, 2004

(54) SPARK PLUG INTERNAL COMBUSTION ENGINE

(75) Inventors: Masayuki Segawa, Nagoya (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/937,003

(22) PCT Filed: Jan. 18, 2001

(86) PCT No.: PCT/JP01/00313

§ 371 (c)(1),
(2), (4) Date: Dec. 28, 2001

(87) PCT Pub. No.: WO01/54242

PCT Pub. Date: Jul. 26, 2001

(65) Prior Publication Data

US 2003/0015951 A1 Jan. 23, 2003

(30) Foreign Application Priority Data

Jan. 19, 2000 (JP) ..... 2000-010606

(51) Int. Cl.[7] ..... H01T 13/20
(52) U.S. Cl. ..... 313/141; 313/144
(58) Field of Search ..... 313/141, 142

(56) References Cited

U.S. PATENT DOCUMENTS

| | | | | |
|---|---|---|---|---|
| 4,488,081 A | | 12/1984 | Kondo et al. | 313/141 |
| 4,540,910 A | | 9/1985 | Kondo et al. | 313/11.5 |
| 4,699,600 A | | 10/1987 | Kondo | 445/7 |
| 4,893,051 A | | 1/1990 | Kondo | 313/141 |
| 5,320,569 A | | 6/1994 | Oshima et al. | 445/7 |
| RE34,778 E | | 11/1994 | Kondo | 445/7 |
| 5,488,262 A | * | 1/1996 | Takamura | 313/141 |
| RE35,429 E | | 1/1997 | Kondo | 313/141 |
| 6,078,129 A | | 6/2000 | Gotou et al. | 313/141 |
| 6,094,000 A | | 7/2000 | Osamura et al. | 313/141 |

FOREIGN PATENT DOCUMENTS

| | | | |
|---|---|---|---|
| JP | Sho 58-59581 | | 4/1983 |
| JP | Sho 59-2152 | | 1/1984 |
| JP | Hei 1-319284 | | 12/1989 |
| JP | Hei 2-39073 | | 9/1990 |
| JP | 402242577 A | * | 9/1990 |
| JP | Hei 3-22033 | | 3/1991 |
| JP | Hei 5-101869 | | 4/1993 |
| JP | Hei 6-45050 | | 2/1994 |
| JP | Hei 7-11974 | | 2/1995 |
| JP | Hei 9-7733 | | 1/1997 |
| JP | Hei 11-3765 | | 1/1999 |
| JP | Hei 11-329668 | | 11/1999 |

* cited by examiner

*Primary Examiner*—Vip Patel
(74) *Attorney, Agent, or Firm*—Morgan Lewis & Bockius LLP

(57) ABSTRACT

A spark plug of the present invention is made of an Ir alloy including a specific amount of (1) Rh, (2) Pt, or (3) Rh and Pt or Rh and Ru. The spark plug comprises tips for a center electrode and for a ground electrode that are each 0.6 to 1.8 mm in diameter and 0.2 to 0.7 mm in thickness and for an interlayer made of an Ir alloy including Ni of 40 mass % that has a diameter slightly larger or smaller than that of each tip for the center electrode and for the ground electrode and has a thickness of 0.1 to 0.6 mm. These tips can be manufactured according to the powder processing method, the dissolution method, and so on. The tip for the center electrode is joined to the end surface of the basic body of the center electrode, which is made of a Ni alloy (Inconel 600), according to laser welding. The tip for the interlayer and the tip for the ground electrode are brought into contact with a predetermined position of the ground electrode, and are joined while being pressed according to electric resistance welding. Other parts, such as an insulator and main metal fittings, are each made of general materials and have a general structure. This spark plug is excellent in resistance to lead corrosion, and the tip for the ground electrode is prevented from peeling and falling off from the base because of a thermal expansion difference.

9 Claims, 2 Drawing Sheets

SPARK PLUG INTERNAL COMBUSTION ENGINE

TECHNICAL FIELD

The present invention relates to a spark plug for an internal combustion engine. More specifically, the present invention relates to a spark plug for an internal combustion engine that is capable of preventing an electrode tip from being anomalously corroded by a Pb component included in gasoline, that is excellent in resistance to spark consumption, and that is low in electrode erosion caused by oxidation at high temperatures.

BACKGROUND ART

A spark plug that employs an electrode tip largely composed of Pt is used in practical applications in order to improve resistance to spark consumption. A spark plug that employs an electrode tip of a Pt—Ir alloy largely composed of Pt has also been developed as one that has better resistance to spark consumption. However, there is a case in which, if these electrode tips are joined to the basic body of a center electrode and the base of a ground electrode that are each largely composed of Ni or a Ni alloy according to electric resistance welding, the tips will peel and fall off therefrom because of thermal stress as a result of a thermal expansion difference under a high temperature when they are used.

Therefore, a spark plug has been proposed in which an interlayer including Pt and Ni is disposed between the basic body or the like and the electrode tip so as to ease thermal stress. In addition, practical use is made of a spark plug in which the basic body and the electrode tip are welded to each other according to laser beam welding especially in the center electrode, and a junction layer made of an alloy including Pt, Ni, etc., is formed so as to ease thermal stress.

With the spread of motorization in recent years, a long life spark plug, such as the above-mentioned one, that is excellent in resistance to spark consumption and that is capable of preventing peeling and fall-off of an electrode tip caused by thermal stress has come to be used in many parts of the world. However, in a spark plug provided with an electrode tip chiefly composed of Pt, a compound whose melting point is low is formed between Pt and Pb if gasoline includes Pb. Accordingly, the electrode tip causes anomalous corrosion because of Pb, and, disadvantageously, the life cycle of the spark plug, which has been designed to have high performance and a long life, is on the contrary shortened.

Conventionally, a spark plug that excels in resistance to spark consumption and has a long life, or a spark plug that prevents peeling and fall-off of an electrode tip caused by the difference in a thermal expansion coefficient, as described above in detail, is disclosed by Publication of Unexamined Patent Application No. Hei 1-319284, Publication of Unexamined Patent Application No. Hei 6-45050, Publication of Unexamined Patent Application No. Hei 9-7733, and Publication of Unexamined Patent Application No. Hei 11-3765. However, a full study of the anomalous corrosion of the electrode tip caused by Pb has not been made, and, additionally, there is no description of a spark plug in which an electrode tip is prevented from peeling/falling off because of thermal stress especially when the electrode tip has been joined according to electric resistance welding in a ground electrode.

It is therefore an object of the present invention to provide a spark plug for an internal combustion engine in which a tip is prevented from falling off even if the tip for a ground electrode that is made of Ir or is chiefly composed of Ir is joined to an interlayer that has a specific thermal expansion coefficient and that is formed at a predetermined position of the ground electrode according to electric resistance welding, and, even if gasoline includes Pb, anomalous corrosion is not caused while maintaining great durability.

DISCLOSURE OF INVENTION

A spark plug for an internal combustion engine according to the present invention is characterized in that the spark plug comprises a center electrode comprising a basic body and a tip for the center electrode joined to the basic body and a ground electrode comprising a base, an interlayer formed at a predetermined position of the base, and a tip for the ground electrode joined to the surface of the interlayer, wherein the tip for the center electrode and the tip for the ground electrode are disposed to face each other, the tip for the center electrode and the tip for the ground electrode are each made of Ir or made of an alloy chiefly composed of Ir, a thermal expansion coefficient of the interlayer is between a thermal expansion coefficient of the base and a thermal expansion coefficient of the tip for the ground electrode, the basic body and the tip for the center electrode are joined to each other by laser welding, and the interlayer and the tip for the ground electrode are joined to each other by electric resistance welding.

The "spark plug for an internal combustion engine" may be a parallel electrode type of spark plug in which a tip for a center electrode joined to an end surface of a basic body and a tip for a ground electrode joined to an inner side surface of an end edge of a base are caused to face each other through an interlayer. Alternatively, the "spark plug for an internal combustion engine" may be a multi-electrode type of spark plug provided with a plurality of ground electrodes in which a tip for a center electrode joined to a side surface of an end edge of a basic body and a tip for a ground electrode joined to an end surface of a base through an interlayer are caused to face each other.

Herein, let the end surface or the side surface of the basic body and that of the base signify not only a flat surface but also a bottom surface of a concave part if the concave part is provided to fit and join the tip for the center electrode or the tip for the ground electrode. The material and structure of the members that constitute other parts of this spark plug, i.e., an insulator disposed to be in contact with the circumferential surface of the basic body, main metal fittings disposed to circumscribe the insulator, and terminal metal fittings consecutively connected to the center electrode and disposed on the other side of the insulator are not limited to specific ones, and can be general ones.

The "basic body" that constitutes the center electrode and the "base" that constitutes the ground electrode are each normally made of a Ni simplex or a Ni alloy such as Inconel. The "tip for a center electrode" joined to the basic body and the "tip for a ground electrode" joined to the base through the interlayer are each made of an Ir simplex or an Ir alloy, such as an Ir—Rh alloy and an Ir—Pt alloy, that is chiefly composed of Ir. The "interlayer" is made of an alloy constituting Ir, Ni, Rh, Pt, etc., which are included in the base and in the tip for the ground electrode, and the "thermal expansion coefficient" thereof is between that of the base and that of the tip for the ground electrode.

The tip for the center electrode is joined to the basic body by "laser welding", so as to form a junction that is made of an alloy including the component of the basic body and the component of the tip for the center electrode, i.e., Ni, Ir, etc. The tip for the center electrode has satisfactory resistance to lead corrosion and has excellent durability and is enforced by a material largely composed of Ir, but, from the view point of mass production, it is preferable to make the basic body thereof of a material largely composed of Ni. If the tip and the basic body are made of such materials as above, a difference in the melting point between the tip and the basic body will become much greater than a case in which the tip mainly composed of Pt is welded to the basic body, which has been conventionally carried out.

Further, the center electrode is required to have a thin end in order to improve ignitability and reduce a discharge voltage, and, if a member made of a material that has a very great difference in the melting point to such a thinned end part is welded by electric resistance welding, a large protuberance will be generated, or buckling will occur in the basic body. Further, since the tip mainly composed of Ir has a very great thermal expansion difference to the basic body in comparison with the tip mainly composed of Pt, the weld strength decreases if the protuberance is ground by a cutting tool, and there is a fear that the tip will fall off when used. Further, if the protuberance is used without being ground, consumption will rapidly advance because of a spark discharge from the protuberance made of an alloy of Ir and Ni, and there is a fear that the decrease in the weld strength will cause the tip to fall off. Further, if buckling occurs, the basic body must be ground by the cutting tool and be repaired, and, depending on the degree of buckling, it will become impossible to insert it into a through hole formed in an insulator in order to mount the center electrode if it is used without being ground.

By contrast, if laser welding is employed, such a protuberance or buckling never occurs, and therefore the tip is firmly joined to the basic body without generating the above-mentioned disadvantages, and the tip never peels off and never falls off from the basic body because of the thermal expansion difference between the tip and the basic body.

On the other hand, in the ground electrode, the tip for the ground electrode is joined to the surface of the interlayer according to "electric resistance welding", not laser welding, for a structural reason. The reason being is that the tip is joined to a part of the plane of the base. In other words, if laser welding is carried out, a portion of the laser must be focused on the outer periphery of the joint surface between the tip for the ground electrode and the base, and therefore the laser must be diagonally projected to the joint surface between the tip and the base. For this reason, a fused part cannot be formed by the laser up to the depth of the joint surface, and it is difficult to obtain satisfactory bond strength.

By contrast, if the tip is joined through the interlayer according to electric resistance welding, it is possible to join them over the whole area of the joint surface of the tip and to easily obtain sufficient weld strength. In this case, a protuberance is generated like the side of the center electrode, but this protuberance is not such a great disadvantage as to arise on the side of the center electrode. That is, since the ground electrode side is normally in a positive potential, negative ions each of which has slight mass are merely drawn to the ground electrode during the spark discharge. Therefore, unlike the center electrode side, consumption does not advance, and the weld strength is not easily reduced even if a spark discharge occurs because of the protuberance.

Further, since the tip is welded to the plane of the base, buckling does not occur, and, even if buckling occurs, the necessity to repair the buckling is slight. Further, since the thermal expansion coefficient of the interlayer is in between those of the tip and the base, the tip can be satisfactorily prevented from peeling and falling off because of the thermal expansion difference between the tip and the base even if electric resistance welding is carried out.

For the above-mentioned reasons, the necessity of junction according to laser welding arises on the center electrode side, and the necessity of junction according to electric resistance welding through the interlayer arises on the ground electrode side.

The interlayer may be joined to the base according to laser welding or according to electric resistance welding, but, preferably, it is carried out according to electric resistance welding. Especially, if the interlayer and the tip for the ground electrode are simultaneously joined to the base, the number of process steps can be reduced, and the ground electrode can be easily and cheaply formed.

The respective tips for the center electrode and for the ground electrode are excellent in resistance to spark consumption, and are each made of Ir or an Ir alloy that is not easily corroded even when Pb is included in gasoline, and therefore a spark plug with excellent durability can be realized. However, Ir has a tendency to be oxidized at a high temperature. Especially when an engine is placed in a severe use environment, such as high revolutions or high power, the temperature in the vicinity of an electrode, especially in the vicinity of a ground electrode, reaches 900° C. and occasionally exceeds 1000° C., and the tip has a tendency to be easily consumed because of the oxidation at high temperatures. Therefore, it is preferable to make the tip of an alloy consisting of Ir, Rh, and Pt, etc., which are excellent in resistance to oxidation at high temperatures.

It is particularly preferable to make these tips of an alloy chiefly composed of Ir that contains (1) Rh of 1.5 to 50 mass %, (2) Pt of 1 to 10 mass %, or Rh of 1.5 to 50 mass % and Pt or Ru of 1 to 10 mass %. If Rh is less than 1.5 mass % or if Pt or Ru is less than 1 mass %, the resistance to oxidation at high temperatures does not satisfactorily improve. On the other hand, if Rh exceeds 50 mass %, the resistance to spark consumption shows a tendency to decrease slightly. However, since this Rh facilitates the processing of an electrode tip, it is preferable to set the quantitative ratio of Rh at 7 to 40 mass %, especially 10 to 30 mass %. If Pt or Ru exceeds 10 mass %, the melting point of the electrode tip decreases, and the processing becomes more difficult than a case in which only Ir is used, and therefore it is preferable to set the quantitative ratio of Pt or Ru at 2 to 7 mass %.

In the tip for the center electrode and in the tip for the ground electrode, the Ir content is the highest in mass ratio, and the Rh, Pt or Ru content is second highest. If other metals are included, it is preferable to set their contents at a minimum. Even if it is an alloy mainly composed of Ir, sufficient resistance to lead corrosion will not always be obtained if gasoline including Pb is used and if the second metal in the content is Ni.

Preferably, each tip has the shape of a cylinder or a circular truncated cone, and the diameter is 0.6 to 1.8 mm, especially 0.6 to 1.4 mm, and the thickness is 0.2 to 0.7 mm, especially 0.4 to 0.7 mm.

Preferably, the interlayer is made of an alloy chiefly composed of Pt or Ir. Unlike the tips for the center electrode and for the ground electrode, this interlayer does not discharge, and therefore Ir is not indispensable. The interlayer has sufficient durability and never peels off and never falls off from the base even if the second metal following the chief component in content is Ni. The interlayer can be made of an Ir alloy including Ni of 30 to 50 mass %, an Ir alloy including Rh of 30 to 50 mass %, or a Pt alloy including Ni of 10 to 30 mass %.

Preferably, the interlayer has a thermal expansion coefficient of "$10\times10^{-6}$/° C. to $16\times10^{-6}$/° C." at 900° C. measured by a thermal expansion analyzer. If the thermal expansion coefficient of the interlayer is less than $10\times10^{-6}$/° C., the difference in the thermal expansion coefficient to the base made of a Ni simplex or made of a Ni alloy increases, and, undesirably, the interlayer occasionally peels and falls off from the base. On the other hand, if the thermal expansion coefficient of the interlayer exceeds $16\times10^{-6}$/° C., the difference in the thermal expansion coefficient between the tip for the ground electrode and the interlayer increases, and, undesirably, the tip occasionally peels and falls off from the interlayer. If the thermal expansion coefficient of this interlayer is $12\times10^{-6}$/° C. to $15\times10^{-6}$/° C., the tip for the ground electrode and the interlayer can be prevented from peeling and falling off, and, more desirably, it is possible to realize a spark plug with sufficient durability.

Further, preferably, the whole surface of the interlayer is covered with the tip for the ground electrode. Especially, in the interlayer made of an alloy including at least one of Pt and Ni of more than 30 mass % or more than 40 mass %, the anomalous corrosion caused by Pb can be prevented by covering the whole surface thereof with the tip for the ground electrode as shown in FIG. 3 when gasoline including Pb is used. Since the interlayer does not discharge, a case does not occur in which the anomalous corrosion caused by Pb is further accelerated by spark consumption. However, the structure where the whole surface is covered with the tip for the ground electrode makes it possible to realize a spark plug excellent in durability with greater reliability.

Preferably, this interlayer has a diameter within a range of 0.1 to 0.3 mm below the diameter of the tip for the ground electrode to a diameter 0.1 to 0.5 mm above the diameter thereof, and has a thickness of 0.1 to 0.6 mm, especially about 0.2 to 0.5 mm.

In an internal combustion engine in a state of high revolutions and high power, the temperature in the vicinity of the electrode reaches a high temperature exceeding 800 to 900° C., and sometimes reaches 1000° C. The ground electrode especially has a tendency to easily reach a higher temperature. Therefore, preferably, a "good thermal conduction core" that consists of a metal whose thermal conductivity is high is disposed in the interior of the base of the ground electrode as shown in a fifth aspect of the present invention because Ir is easily oxidized and evaporated at such high temperatures.

The core body of a good thermal conduction core is made of pure Ni or iron, etc., and the exterior thereof is surrounded by Cu or Ag, etc., from the neighborhood of the tip for the ground electrode to the main metal fittings, as shown in FIG. 3. As a result, the heat in the vicinity of the end of the ground electrode including the tip is transmitted to the main metal fittings through a good thermal conduction core, and is further transmitted to the cylinder head of the engine. Accordingly, the so-called "heat sweeping" makes it possible to sufficiently prevent the tip from reaching a high temperature above 900° C. in which the tip is easily oxidized and evaporated, and makes it possible to ease the thermal stress caused by the thermal expansion difference between the base and the interlayer and between the interlayer and the tip for the ground electrode, and therefore it is possible to realize a spark plug provided with superior durability.

There is a situation in which cracks appear in the base because of thermal expansion and shrinkage of a good thermal conduction core when this conduction core is disposed up to the end of the base. Therefore, the good thermal conduction core is usually disposed to the neighborhood of the tip for the ground electrode as shown in FIG. 3.

The manufacturing method of the tips for the center electrode and for the ground electrode and the manufacturing method of the tip for forming the interlayer are not limited to specific ones. However, it is preferable to manufacture especially the tip for the ground electrode and the tip for forming the interlayer according to a rolling process. The reason being is that each tip is pressed in the thickness direction when electric resistance welding is carried out, and, if it has a level crystal structure in the direction perpendicular to the direction in which it is pressed, weld cracks do not easily occur. The tip for the center electrode may be manufactured according to the rolling process, but there is no absolute need to do so. The tips for the center electrode and for the ground electrode and the tip for forming the interlayer can be manufactured according to various methods, such as a hot rolling method, a hot wire drawing method, a powder sintering method, or a hot header processing method.

BEST MODE FOR CARRYING OUT THE INVENTION

Figure 1:
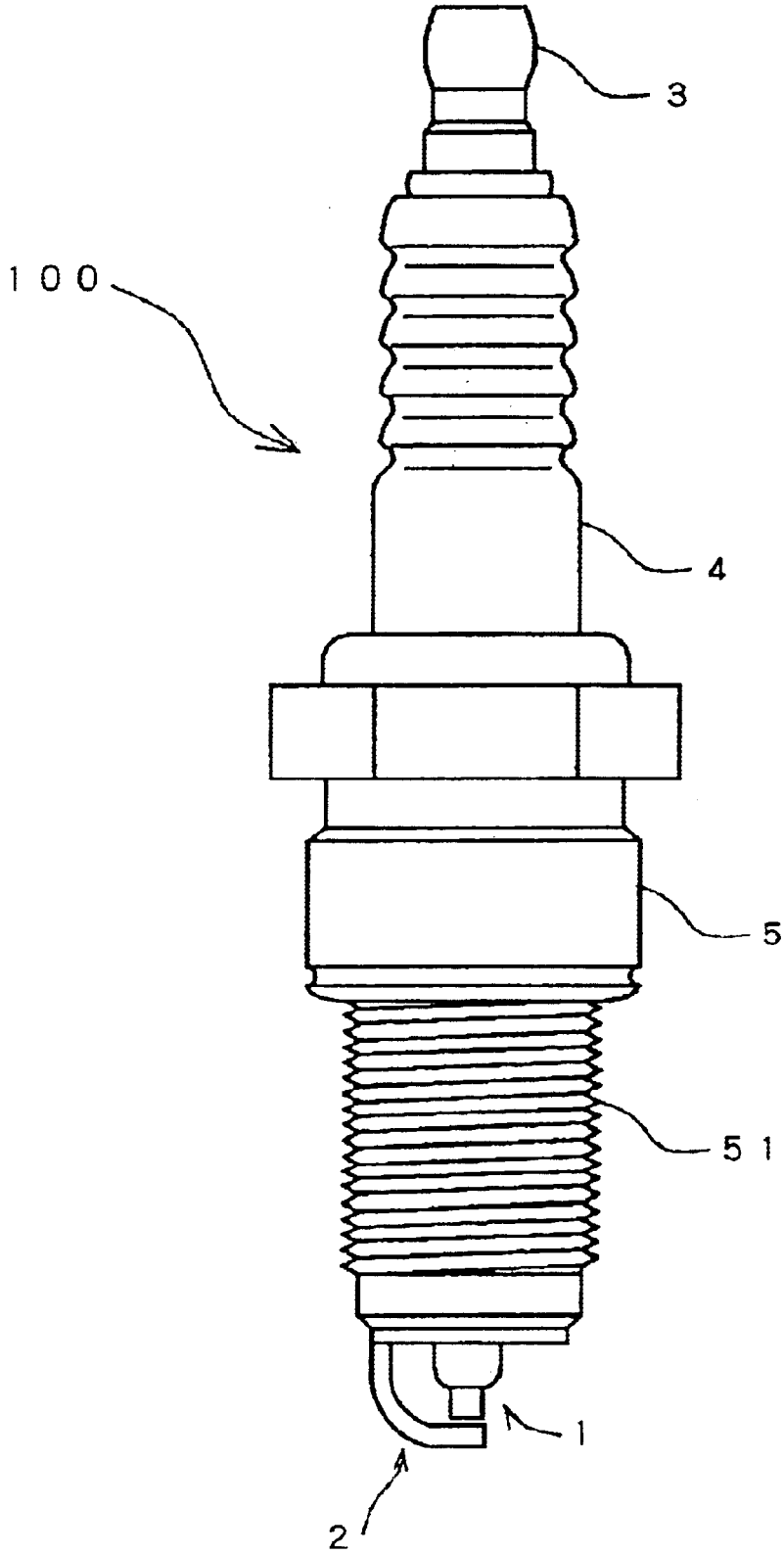
FIG. 1 is a front view of a spark plug.

[1] Influence that the Composition of Tips for a Center Electrode and for a Ground Electrode Exerts on Resistance to Lead Corrosion

Experimental Examples 1 Through 21

(1) Manufacture of a Spark Plug

Tips for a center electrode and for a ground electrode where each are made of an Ir simplex or made of an alloy including each metal listed in Table 1 and that are each 0.9 mm in diameter and 0.6 mm in thickness, and a tip for an interlayer that is made of an Ir alloy including Ni of 40 mass % and that is 1.2 mm in diameter and 0.3 mm in thickness were manufactured according to the powder processing method. Thereafter, the tip for the center electrode was joined to the end surface of the basic body of the center electrode that is made of a Ni alloy (Inconel 600) according to laser welding. The tip for the interlayer was brought into contact with a predetermined position of the base of the ground electrode that is likewise made of Inconel 600, and the tip for the ground electrode was brought into contact with the center part of the tip for the interlayer, and these were joined according to electric resistance welding while pressing them.

The tips for the center electrode, for the ground electrode, and for the interlayer may be manufactured according to the dissolution method.

Excepting the fact that the center electrode and the ground electrode were formed in this way, the materials of other parts, such as an insulator and main metal fittings, of the spark plug and the entire structure thereof are identical with those of a conventional general spark plug, and the spark plug shown in Experimental examples 1 through 21 was manufactured.

TABLE 1

| Experimental | Content of metallic element that forms tips (mass %) | | | | | Thermal expansion coefficient | Gap increment |
|---|---|---|---|---|---|---|---|
| example | Ir | Rh | Pt | Ru | Ni | ($\times 10^{-6}$/° C.) | (mm) |
| 1 | 20 | | 80 | | | 8.51 | >0.40 |
| 2 | | | 80 | | 20 | 15.21 | >0.20 |
| 3 | 100 | | | | | 8.22 | 0.12 |
| 4 | 99 | 1 | | | | 8.34 | 0.10 |
| 5 | 98 | 2 | | | | 8.46 | 0.05 |
| 6 | 95 | 5 | | | | 8.55 | 0.02 |
| 7 | 95 | 2 | | 3 | | 8.60 | 0.01 |
| 8 | 90 | 10 | | | | 8.87 | 0.02 |
| 9 | 80 | 20 | | | | 9.01 | 0.03 |
| 10 | 70 | 30 | | | | 9.14 | 0.04 |
| 11 | 60 | 40 | | | | 9.22 | 0.05 |
| 12 | 50 | 50 | | | | 9.35 | 0.06 |
| 13 | 45 | 55 | | | | 9.42 | 0.10 |
| 14 | 40 | 60 | | | | 9.50 | 0.15 |
| 15 | 30 | 70 | | | | 9.58 | 0.25 |
| 16 | 99.5 | | 0.5 | | | 8.36 | 0.10 |
| 17 | 99 | | 1 | | | 8.40 | 0.03 |
| 18 | 98 | | 2 | | | 8.53 | 0.02 |
| 19 | 95 | | 5 | | | 8.69 | 0.02 |
| 20 | 92 | | 8 | | | 8.82 | 0.04 |
| 21 | 88 | | 12 | | | 8.95 | 0.10 |

(2) Evaluation of Resistance to Lead Corrosion

A 3000 cc-displacement and 6-cylinder gasoline engine was used, an endurance test of 100 hours was performed under a condition of 5000 rpm and WOT (wide open throttle), and the gap increment between the tip for the center electrode and the tip for the ground electrode was measured with a pin gauge. Gasoline that includes tetraethyl lead of 0.4 g/l was used as fuel. In each case, the maximum temperature of the basic body was 850 to 900° C.

Results are also listed in Table 1.

Examination Results

From the results of Table 1, it can be understood that the gap increment between the tips for the center electrode and for the ground electrode caused by corrosion is 0.05 mm or less in each of Experimental examples 3, 5 through 12, and 17 through 20, and the anomalous corrosion caused by Pb is very slight, and therefore practical problems do not exist. On the other hand, a gap increment exceeded 0.4 mm in Experimental example 1 in which a tip chiefly composed of Pt was used, and it exceeded 0.2 mm in Experimental example 2 in which a tip chiefly composed of Pt was likewise used, and the anomalous corrosion caused by Pb was remarkable. Further, the gap increment was 0.1 mm or more in experimental examples 4 and 16 in which a tip where Rh or Pt in comparison with Ir is too little was used and in Experimental examples 13, 14, 15, and 21 in which a tip where Rh or Pt in comparison with Ir is excessive was used, and therefore it is understood that the tip is easily corroded by Pb. These results confirm the effectiveness concerning the lead corrosion resistance of a tip that is made of Ir or made of an alloy that is chiefly composed of Ir and contains a proper quantity of Rh, Pt, etc.

[2] Consideration of an Influence that the Presence or Absence of an Interlayer Exerts on the Fact that a Tip Peels and Falls Off Embodiment 1

(1) Manufacture of a Spark Plug

Tips for a center electrode and for a ground electrode that are each made of an Ir alloy including Rh of 40 mass % or Pt of 5 mass % and that are each 0.9 mm in diameter and 0.6 mm in thickness, and a tip for an interlayer that is made of an Ir alloy including Ni of 40 mass % and that is 1.2 mm in diameter and 0.3 mm in thickness were manufactured according to the powder processing method. Thereafter, the tip for the center electrode was joined to the end surface of the basic body of the center electrode that is made of a Ni alloy (Inconel 600) according to laser welding. The tip for the interlayer was brought into contact with a predetermined position of the base of the ground electrode that is likewise made of Inconel 600, and the tip for the ground electrode was brought into contact with the center part of the tip for the interlayer, and these were joined according to electric resistance welding while pressing them.

Excepting the fact that the center electrode and the ground electrode were formed as above, the materials of other parts, such as an insulator and main metal fittings, of the spark plug and the entire structure thereof were designed to be identical with those of a conventional general spark plug.

Comparative Example 1

Excepting the fact that the tip for the ground electrode was joined directly to a predetermined position of the base of the ground electrode according to electric resistance welding without using the tip for the interlayer, the spark plug was manufactured in the same way as in Embodiment 1.

As shown in FIG. 1, the spark plug 100 according to the Embodiment 1 is made up of a center electrode 1, a ground electrode 2, a terminal electrode 3, an insulator 4 that fixes these electrodes and holds them, and a main metal fitting 5 that houses and protects the insulator 4. The main metal fitting 5 has a thread part 51 used to mount the spark plug on an engine block, not shown.

Figure 2:
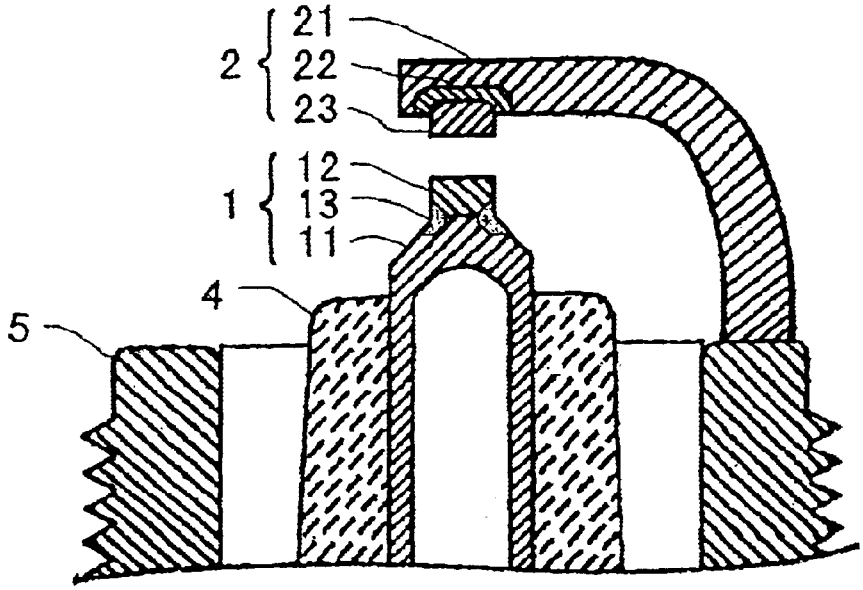
FIG. 2 is an enlarged longitudinal sectional view showing the neighborhood of the center electrode and the ground electrode of a spark plug in which an interlayer is disposed between the tip and the base in the ground electrode.

FIG. 2 is an enlarged longitudinal sectional view showing the neighborhood of the center electrode and the ground electrode of the spark plug in which an interlayer is disposed between the tip of the ground electrode and the base. The center electrode 1 is made up of a basic body 11 and a tip 12 for the center electrode, and the ground electrode 2 is made up of a base 21, an interlayer 22, and a tip 23 for the ground electrode. The ground electrode 2 is connected to a part of the end surface of the main metal fitting 5, and the other end thereof is disposed to face the center electrode 1. The tip 12 for the center electrode is joined to the basic body 11 by a junction 13 formed according to laser welding. Excepting the fact that an interlayer is not formed, the spark plug of Comparative example 1 is constructed in the same way as in Embodiment 1.

(2) Inspection of the Occurrence or Non-Occurrence of Fall-Off of the Tip for the Ground Electrode A 3000 cc-displacement and 6-cylinder gasoline engine was used, and a temperature endurance test was performed for 300 hours at a cycle of 5000 rpm, WOT×1 minute, and idling (about 600 rpm)×1 minute. Lead-free gasoline was used as fuel. After the examination, the spark plug was dismantled, and the tip for the ground electrode was inspected to determine whether the tip had fallen off from the base or not.

Examination Results

In the case of the spark plug having the interlayer, the tip for the ground electrode neither peeled nor fell off because of thermal stress caused by the repetition of heating/cooling regardless of the composition of the tip, and the interlayer and the tip were in a state of being firmly joined to the base after examination. On the other hand, in the case of the ground electrode not having an interlayer, it was dismantled after examination and was inspected. Results indicated that the tip for the ground electrode peeled and fell off from the base. Accordingly, it can be understood that, from the viewpoint that the tip is prevented from peeling and falling off in a state where a good thermal conduction core is not disposed, the formation of the interlayer makes it possible to infallibly prevent the tip from peeling and falling off even under severe conditions.

The thermal expansion coefficients at 900° C. of the tips for the center electrode and for the ground electrode are as in Table 1. As shown in the table, the thermal expansion coefficient ($13.58\times10^{-6}$/° C.) at 900° C. of the tip for the interlayer is between the thermal expansion coefficient of each tip and the thermal expansion coefficient at 900° C. of Inconel 600 ($16.10\times10^{-6}$/° C.), and, from this, it can be again understood that the tip is infallibly prevented from peeling and falling off.

Figure 3:
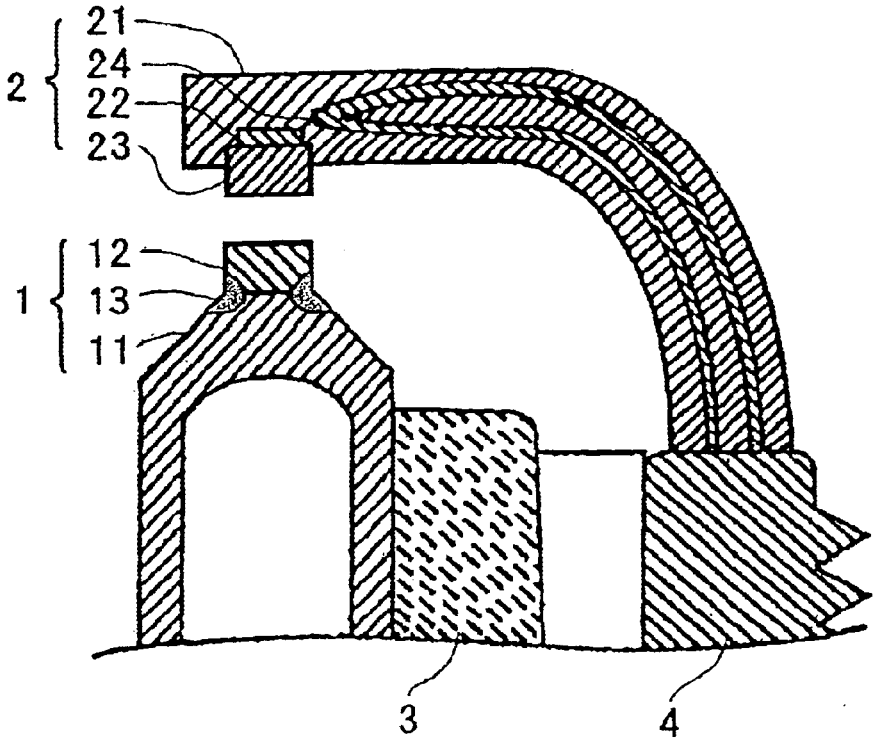
FIG. 3 is an enlarged longitudinal sectional view showing the neighborhood of the center electrode and the ground electrode of a spark plug in which the whole surface of an interlayer is covered with a tip for the ground electrode and in which a good thermal conduction core is disposed in the interior of the ground electrode.

It should be noted that the present invention is not limited to the above-mentioned specific embodiment, and can be variously modified within the range of the present invention depending on objects, uses, etc. For example, a spark plug can be achieved in which the whole surface of the interlayer is covered with the tip for the ground electrode so as to have excellent resistance to lead corrosion, as shown in FIG. 3. Further, a spark plug can be achieved in which a good thermal conduction core 24 is disposed in the interior of the ground electrode 2. If it is constructed in this way, the maximum temperature of the fringes of the tip for the ground electrode can be controlled to be a very low temperature of 800 to 850° C., and thereby the tip is more reliably prevented from peeling and falling off.

Industrial Applicability

According to the present invention, it is possible to realize an excellently durable and long life spark plug for an internal combustion engine in which tips for a center electrode and for a ground electrode are not subjected to anomalous corrosion caused by Pb, and the tips are prevented from falling off because of a thermal expansion difference between the tip of the ground electrode and a base. Further, a spark plug superior in durability can be realized by using an alloy provided with the specific composition of the present invention and by employing the specific structure of the present invention.

What is claimed is:

1. A spark plug for an internal combustion engine comprising:

a center electrode including a basic body and a first tip joined to said basic body; and a ground electrode including a base having an interlayer formed at a predetermined position of said base, and a second tip joined to a surface of said interlayer, wherein said first tip and said second tip are disposed to face each other, said first tip and said second tip are each made of Ir or made of an Ir alloy, wherein a thermal expansion coefficient of said interlayer is between a thermal expansion coefficient of said base and a thermal expansion coefficient of said second tip, and the basic body and the first tip are joined by a laser weld.

2. The spark plug for an internal combustion engine according to claim 1, wherein said first tip and said second tip are each made of an Ir alloy that contains (1) Rh of 1.5 to 50 weight %, (2) Pt of 1 to 10 weight %, (3) Rh of 1.5 to 50 weight % and Pt of 1 to 10 weight % or (4) Rh 1.5 to 50 weight % and Ru of 1 to 10 weight %, and said interlayer is made of an Ir or Pt alloy.

3. The spark plug of an internal combustion engine according to claim 1, wherein a thermal expansion coefficient at 900° C. of said interlayer is $10\times10^{-6}$/° C. to $16\times10^{-6}$/° C.

4. The spark plug for an internal combustion engine according to claim 1, wherein the whole surface of said interlayer is covered with said second tip.

5. The spark plug for an internal combustion engine according to claim 1, wherein a good thermal conduction core is disposed in an interior of said base of said pound electrode.

6. The spark plug for an internal combustion engine according to claim 2, wherein a thermal conduction core is disposed in an interior of said base of said ground electrode.

7. The spark plug for an internal combustion engine according to claim 3, wherein a thermal conduction core is disposed in an interior of said base of said ground electrode.

8. The spark plug for an internal combustion engine according to claim 4, wherein a thermal conduction core is disposed in an interior of said base of said ground electrode.

9. The spark plug for an internal combustion engine according to claim 1, wherein said interlayer and said second tip are joined to each other by electric resistance welding.

* * * * *